United States Patent [19]

Mason et al.

[11] Patent Number: 4,759,163

[45] Date of Patent: Jul. 26, 1988

[54] ROOF DRAIN ASSEMBLY

[76] Inventors: Robert W. Mason, 1476 Mississauga Rd. N., Mississauga, Ontario, Canada, L4H 2J8; Harvey C. Robertson, 179 Pearl St., West Seneca, N.Y. 14224

[21] Appl. No.: 885,184

[22] Filed: Jul. 14, 1986

[51] Int. Cl.[4] ..... E04H 12/28

[52] U.S. Cl. ..... 52/199; 52/58

[58] Field of Search ..... 52/199, 58; 285/42 AB

[56] References Cited

U.S. PATENT DOCUMENTS

| | | | |
|---|---|---|---|
| 870,917 | 11/1907 | Weston . | |
| 1,322,189 | 11/1919 | Holt . | |
| 1,779,941 | 10/1930 | Kerr . | |
| 1,875,640 | 9/1932 | Moore | 52/58 X |
| 2,121,789 | 6/1938 | Davey . | |
| 2,716,428 | 8/1955 | Pennella . | |
| 3,420,652 | 1/1969 | Mork | 285/42 |
| 3,615,984 | 10/1971 | Chase . | |
| 3,977,137 | 8/1976 | Patry | 52/58 X |
| 4,010,578 | 3/1977 | Logsdon | 52/58 |
| 4,372,585 | 2/1983 | Evora | 52/58 X |
| 4,505,499 | 3/1985 | Uglow et al. | 52/199 X |
| 4,512,119 | 4/1985 | Willoughby | 52/58 |

FOREIGN PATENT DOCUMENTS

| | | | |
|---|---|---|---|
| 54915 | 6/1938 | Denmark | 285/42 |
| 159979 | 6/1933 | France | 52/58 |

*Primary Examiner*—William F. Pate, III
*Assistant Examiner*—Creighton Smith
*Attorney, Agent, or Firm*—Bacon & Thomas

[57] ABSTRACT

In a roof drain assembly comprising an existing roof structure having an opening therethrough with a drainage duct extending downwardly through the opening, and a re-roofing structure which includes a layer of insulation and which is disposed over the existing roof structure with an opening through the re-roofing structure in alignment with the opening through the existing roof structure, a drain extension pipe extends through the opening in the re-roofing structure and into the upper end portion of the drainage duct. The portion of the drain extension pipe within the drainage duct is of a non-resiliently deformable material such as lead, and this non-resiliently deformable portion of the drain extension pipe is outwardly mechanically deformed against the drainage duct to provide a substantially water-tight seal therebetween. In use an outer tube to which the upper plate is secured is prevented from turning, and an inner shaft which is screw-threadedly disposed through the upper plate and on the lower end of which the lower plate is mounted is turned in the appropriate direction to cause the lower plate to move towards the upper plate with resultant axial compression and outward expansion of the resiliently deformable annulus against the non-resiliently deformable portion of the drain extension pipe.

7 Claims, 1 Drawing Sheet

ROOF DRAIN ASSEMBLY

Figure 1:
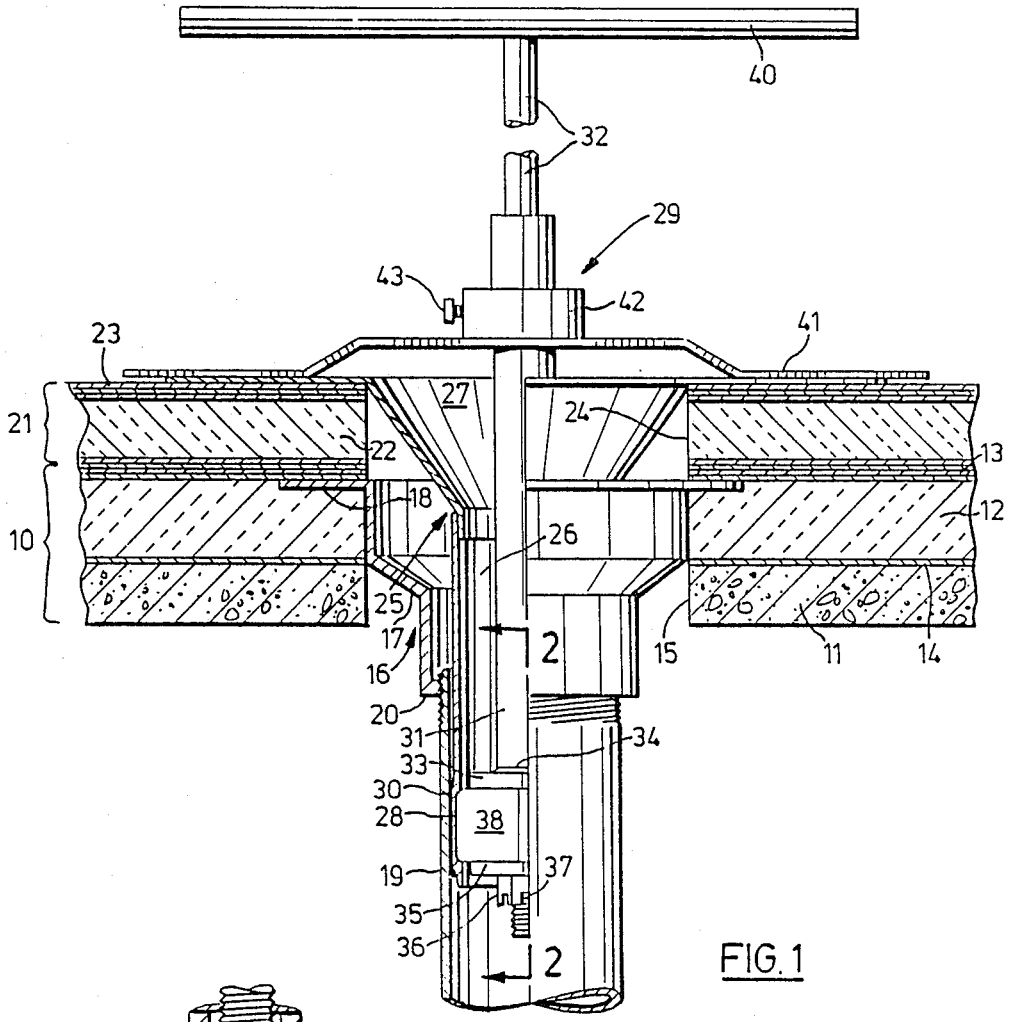

This invention is concerned with the provision of a roof drain assembly. It is conventional particularly in flat-roofed buildings for the roof structure to comprise a roof deck which may, for example, be of concrete form or may comprise a corrugated sheet metal structure. Above the roof deck is a layer of thermal insulation, with a roof membrane in the form of layers of bitumen-coated roofing felts disposed over the insulation, and a layer of gravel chips disposed over the roofing felts unless the roof membrane does not require the protection of such a layer of gravel chips. A vapor retarder may be provided between the roof deck and the insulation. For removing rainwater from this existing roof structure there is provided therethrough one or more openings with a drainage duct extending downwardly through each opening. In some cases this drainage duct may comprise a drain member which may be of, for example, cast iron and which has an upper, outwardly projecting flange disposed between the insulation and the roof membrance and a lower end portion to which is screw-threadedly connected the upper end portion of a leader pipe, the drain member being supported by a bracket arrangement secured to the roof deck.

Frequently after a period of time such existing roof structures become damaged or deteriorate in that, for example, the roof membrane may crack thereby permitting rainwater to pass through the roof membrane into the layer of insulation thus adversely affecting the thermal insulating properties of this insulation. When such damage or deterioration occurs in the existing roof structure it is conventional, rather than removing and replacing the insulation and roof membrane of the existing roof structure, for a further layer of thermal insulation to be disposed over the existing roof structure with a further roof membrane disposed over this further layer or layers of insulation, any layer of gravel chips incorporated in the existing roof structure being first removed. An opening in alignment with the opening in the existing roof structure is provided through the re-roofing structure comprising the further layer of insulation and the further roof membrane, a drain extension pipe extending through this opening in the re-roofing structure and into the upper end portion of the drainage duct since, of course, the upper surface of the re-roofing structure is at a raised level relative to the upper surface of the existing roof structure and since it is frequently difficult if not impossible to remove and replace the drainage duct associated with the existing roof structure. The re-roofing structure may include a further layer of gravel chips which is disposed over the further roof membrane unless the further roof membrane does not require such protection.

The drain extension pipe is a clearance fit within the upper end portion of the drainage duct, but in the event of an exceptionally heavy rainfall or if there is a blockage or partial blockage in the drainage duct or in the drain system to which the drainage duct is connected rainwater may back-up between the drain extension pipe and the upper end portion of the drainage duct and thereby enter the layer of insulation of the re-roofing structure. As hereinbefore described in relation to the thermal insulation of the existing roof structure the entry of rainwater into the insulation has an adverse effect on the insulation, so that it has been conventional for caulking or other means such as O-rings to be provided between the drain extension pipe and the upper end portion of the drainage duct in order substantially to prevent such back-up of rainwater therebetween. However, the use of, for example, caulking is not entirely satisfactory since the caulking may deteriorate and rupture, and during the assembly operation the provision of the caulking may be inadvertently omitted and this, of course, is not apparent from a subsequent visual inspection of the completed assembly. Furthermore, the use of O-rings has not proved entirely satisfactory, and while the provision of drainage ducts which are adjustable in height has previously been proposed these adjustable drainage ducts are relatively complex and expensive and substantially reduce the cross-sectional area for the flow of rainwater therethrough.

It is a primary object of the present invention to provide a roof drain assembly which substantially obviates or at least mitigates the above-described disadvantages of the roof drain assemblies as hitherto proposed and used.

In accordance with said one aspect of the present invention there is provided a roof drain assembly comprising an existing roof structure, at least one opening through the existing roof structure, a drainage duct extending downwardly through the opening, a re-roofing structure which comprises a layer of insulation and which is disposed over the existing roof structure, an opening through the reroofing structure in alignment with the opening through the existing roof structure, and a drain extension pipe extending through the opening in the re-roofing structure and into the upper end portion of the drainage duct. At least a portion of the drain extension pipe within the drainage duct is of a non-resiliently deformable material, and said non-resiliently deformable portion of the drain extension pipe is in substantially water-tight sealing contact with the drainage duct by outward mechanical deformation of said non-resiliently deformable portion of the drain extension pipe against the drainage duct.

Figure 2:
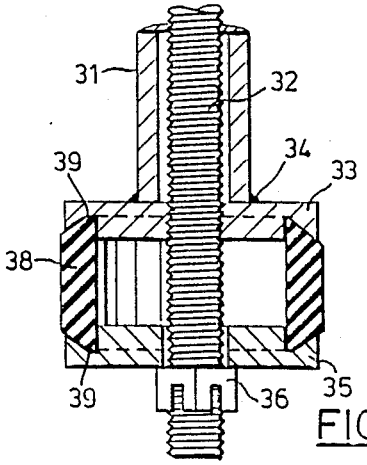

In order that the present invention may be more clearly understood and more readily carried into effect the same will now, by way of example, be more fully described with reference to the accompanying drawings in which FIG. 1 is a partially sectioned view of a roof drain assembly according to a preferred embodiment of the present invention, the view also showing a tool for use in forming the roof drain assembly; and FIG. 2 is a sectioned view on the line 2—2 in FIG. 1 of a portion of the tool shown therein.

Referring to the drawings, 10 denotes generally an existing roof structure of a flat-roofed building, this roof structure 10 comprising a roof deck 11 constituted by a layer of concrete, a layer of thermal insulation 12 disposed on the roof deck 11, and a roof membrane 13 which is disposed over the insulation 12 and which is constituted by a plurality of layers of bitumen-coated roofing felt. Alternatively, the roof deck 11 may be of other forms of construction such as, for example, of corrugated sheet metal construction. A vapor retarder 14 may be disposed between the roof deck 11 and the insulation 12, as is conventional in the art.

One or more openings 15 are provided through the existing roof structure 10, with a drainage duct denoted generally by the reference numeral 16 extending downwardly through each opening 15. As shown in FIG. 1, the drainage duct 16 may comprise a drain member 17 which may be of cast iron and which has an outwardly projecting flange 18 disposed between the insulation 12 and the roof membrane 13, the drain member 17 being supported by a bracket arrangement (not shown) secured to the roof deck 11. The drainage duct 16 also comprises a leader pipe 19, the upper end portion of which is screw-threadedly connected to the lower end portion 20 of the drain member 17.

In view of damage to or deterioration of the roof membrane 13 and/or the insulation 12 of the existing roof structure 10 area roofing structure denoted generally by the reference numeral 21 is disposed over the existing roof structure 10, this re-roofing structure 21 comprising a layer of thermal insulation 22 and a roof membrane 23 which is constituted by layers of bitumen-coated roofing felt and which is disposed over the insulation 22. A layer of gravel chips (not shown) which may be disposed on the roof membrane 13 of the existing roof structure 10 is removed before the re-roofing structure 21 is disposed over the existing roof structure 10. An opening 24 in alignment with the opening 15 is provided through the re-roofing structure 21, and a drain extension pipe denoted generally by the reference numeral 25 extends through this opening 24 in the re-roofing structure 21 and into the upper end portion of the leader pipe 19 of the drainage duct 16, this drain extension pipe 25 comprising, in the preferred embodiment illustrated, a pipe portion 26 and an outwardly projecting flange portion 27 which may include a funnel-shaped part and which is securely interconnected in a substantially water-tight manner as, for example, by soldering or brazing to the upper end of the pipe portion 26.

The pipe portion 26 of the drain extension pipe 25 is of a nonresiliently deformable material, and the flange portion 27 of the drain extension pipe 25 may be of a different material than the pipe portion 26. Thus, for example, the pipe portion may be of seamless lead construction with the flange portion 27 being of copper. The pipe portion 26 is outwardly mechanically deformed as indicated by the reference numeral 28 into substantially water-tight sealing contact with the leader pipe 19 of the drainage duct 16, this outwardly mechanical deformation of the pipe portion 26 of the drain extension pipe 25 being achieved by the use of a tool 29 which is hereinafter more fully described. Bonding material 30 may be provided between the outwardly mechanically deformed pipe portion 26 of the drain extension pipe 25 and the leader pipe 19 of the drainage duct 16 in order to improve the water-tight seal therebetween, this bonding material 30 being provided by disposing a bead of the bonding material between the pipe portion 26 of the drain extension pipe 25 and the leader pipe 19 of the drainage duct 16 prior to the outward mechanical deformation of the pipe portion 26 against the leader pipe 20.

The tool 29 comprises an outer tube 31 within which is rotatably mounted an inner shaft 32. An upper plate 33 is secured as by welding 34 to the lower end of the tube 31, and a lower plate 35 is mounted on the inner shaft 32 in spaced relation below the upper plate 33, this lower plate 35 being so mounted by means, for example, of a nut 36 which is screw-threadedly engaged with the lower end portion of the inner shaft 32 and which may be of castellated form with a lock pin 37 disposed through an aperture in the inner shaft 32 in order to lock the nut 36 in position. Surrounding the inner shaft 32 between the upper and lower plates 33, 35 is a resiliently deformable annulus 38 which is preferably of rubber and in which, as shown in FIG. 2, the upper and lower edges thereof may be of tapered form with these upper and lower edges disposed within corresponding formed notches 39 in the adjacent faces of the upper and lower plates 33, 35. By removing the lock pin 37 the nut 36 may be unscrewed from the lower end portion of the inner shaft 32 thereby permitting removal of the lower plate 35 for replacement of the resiliently deformable annulus 38.

The upper end of the inner shaft 32 is provided with a cross bar 40 which operatively serves as a handle for turning the inner shaft 32 relative to the upper plate 33 through which the inner shaft 32 extends in screw-threaded engagement therewith. Means is provided for operatively preventing turning of the upper plate 33, this means as shown in the drawings preferably comprising a cross plate 41 which is secured to the outer tube 31. Preferably, the cross plate 41 presents a boss 42 in which a set screw 43 is screw-threadedly mounted so that the position along the outer tube 31 at which the cross plate 41 is secured thereto may be adjusted.

In order to form the outwardly mechanically deformed part 28 of the pipe portion 26 of the drain extension pipe 25 using the tool 29, the tool 29 is positioned as shown in FIG. 1 with the expansion assembly comprising the upper and lower plates 33 and 35 and the resiliently deformable annulus 38 at the desired position within the pipe portion 26, the position of the cross plate 41 on the outer tube 31 being adjusted so that with the expansion assembly at the abovedescribed position the cross plate 41 is in bearing contact with the flange portion 27 of the drain extension pipe 25. The operator stands on the outer end portions of the cross plate 41 thereby to prevent turning of the outer tube 31 and hence also the upper plate 33, and by turning the inner shaft 32 by means of the cross bar 40 in the appropriate direction relative to the upper plate 33 the lower plate 35 is caused to move towards the upper plate 33 with resultant axial compression of the resiliently deformable annulus 38 and outward expansion of this resiliently deformable annulus 38 against the pipe portion 26 of the drain extension pipe 25 thereby to produce the outward mechanical deformation 28 of the pipe portion 26 against the leader pipe 19. Thereafter, the inner shaft 32 is turned by means of the cross bar 40 in the opposite direction in order to cause the lower plate 35 to move away from the upper plate 33 thereby to relieve the above-described outward expansion and axial compression of the resiliently deformable annulus 38, and the tool can then be withdrawn.

It will of course be appreciated that instead of the cross plate 41 being adjustably secured to the outer tube 31 the cross plate 41 could be permanently secured to the outer tube 31 at a position such that the expansion assembly is operatively positioned at the lowest level at which it would be desired to form the outward mechanical deformation 28 in the pipe portion 26 of the drain extension 25. In order to form this outward mechanical deformation 28 at a higher level in the pipe portion 26 spacers of appropriate thickness can be operatively disposed under the outer end portions of the cross plate 41. Furthermore, if the outer edge part of the flange portion 27 of the drain extension pipe 25 is provided with an upstanding rib so that the outer end portions of the cross plate 41 would operatively be supported on this rib, spacers may be disposed under the cross plate 41 in order to prevent damage to the rib. The purpose of such an upstanding rib is to serve as a gravel stop to prevent a layer of gravel chips (not shown) which may be disposed in the roof membrane 23 of the re-roofing structure 21 from falling into the drainage duct 16. If, of course, the flange portion 27 of the drain extension pipe 25 does not incorporate such a gravel stop rib the flange portion 27 may be disposed between the insulation 22 and the roof membrane 23 of the re-roofing structure 21, rather than on top of the roof membrane.

We claim:

1. A roof drain assembly comprising an existing roof structure, at least one opening through the existing roof structure, a drainage duct extending downwardly through the opening, a re-roofing structure which comprises a layer of insulation and which is disposed over the existing roof structure, an opening through the re-roofing structure in alignment with the opening through the existing roof structure, and a drain extension pipe extending through the opening in the re-roofing structure and into the upper end portion of the drainage duct, at least a portion of the drain extension pipe within the drainage duct being of a non-resiliently deformable material, and said non-resiliently deformable portion of the drain extension pipe being in substantially water-tight sealing contact with the drainage duct by outward mechanical deformation of said non-resiliently deformable portion of the drain extension pipe against the drainage duct.

2. A roof drain assembly according to claim 1, wherein bonding material is provided between said non-resiliently deformable portion of the drain extension pipe and the drainage duct.

3. A roof drain assembly according to claim 1, wherein the drain extension pipe comprises a pipe port comprising said non-resiliently deformable portion of the drain extension pipe, and an outwardly projecting flange portion at the upper end of the pipe portion.

4. A roof drain assembly according to claim 3, wherein the flange portion of the drain extension pipe includes a funnel-shaped part.

5. A roof drain assembly according to claim 3, wherein the pipe portion and the flange portion of the drain extension pipe are of different materials, the pipe portion and the flange portion of the drain extension pipe being securely interconnected in a substantially watertight manner.

6. A roof drain assembly according to claim 1, wherein said non-resiliently deformable portion of the drain extension pipe is of lead.

7. A roof drain assembly according to claim 5, wherein the pipe portion of the drain extension pipe is of lead, and the pipe portion of the drain extension pipe is of copper.

* * * * *

UNITED STATES PATENT AND TRADEMARK OFFICE

CERTIFICATE OF CORRECTION

PATENT NO. : 4,759,163

DATED : July 26, 1988

INVENTOR(S) : Harvey C. Robertson

It is certified that error appears in the above-identified patent and that said Letters Patent is hereby corrected as shown below:

ON THE TITLE PAGE, ITEM [76],

Delete: "Robert W. Mason, 1476 Mississauga Rd., N.,
Mississauga, Ontario,
Canada, L4H 2J8;"

Signed and Sealed this

Eighth Day of November, 1988

*Attest:*

DONALD J. QUIGG

*Attesting Officer*

*Commissioner of Patents and Trademarks*